US006848683B2

(12) United States Patent
Foshag et al.

(10) Patent No.: US 6,848,683 B2
(45) Date of Patent: Feb. 1, 2005

(54) ARM CLAMP

(75) Inventors: Siegfried Foshag, Neuhausen (DE); Gerhard Klöpfer, Pleidelsheim (DE); Karl Philipp, Bietigheim-Bissingen (DE)

(73) Assignee: Bessey & Sohn GmbH & Co, Bietigheim-Bissingen (DE)

( * ) Notice: Subject to any disclaimer, the term of this patent is extended or adjusted under 35 U.S.C. 154(b) by 0 days.

(21) Appl. No.: 10/300,692

(22) Filed: Nov. 19, 2002

(65) Prior Publication Data

US 2003/0102614 A1 Jun. 5, 2003

(30) Foreign Application Priority Data

Nov. 22, 2001 (DE) ..... 101 58 005

(51) Int. Cl.[7] ..... B25B 1/24

(52) U.S. Cl. ..... 269/3; 269/4; 269/147; 269/283; 269/284

(58) Field of Search ..... 269/283, 284, 269/166–171.5, 3, 4, 6, 147–149, 285, 286

(56) References Cited

U.S. PATENT DOCUMENTS 3,933,346 A * 1/1976 Carver ..... 269/4
5,454,551 A * 10/1995 Hobday ..... 269/170
6,079,703 A * 6/2000 Chavez, Jr. ..... 269/166

FOREIGN PATENT DOCUMENTS

AT 263331 7/1968
DE 28 44 838 4/1980
DE 31 28 023 2/1983
EP 0 010 260 4/1980

OTHER PUBLICATIONS

Photographs 1 and 2 of corpus clamp "Gross & Stabil" of GROSS & Froehlich.

Catalog of Bessey & Sohn GmbH & Co., "Die Korpuszwinge", Dec. 1998.

* cited by examiner

*Primary Examiner*—Robert C. Watson
(74) *Attorney, Agent, or Firm*—Barry R. Lipsitz; Douglas M. McAllister

(57) ABSTRACT

In order to increase the utility of an arm clamp having a guide rail, on which a fixed transverse arm is seated, having a sliding arm which is displaceable on the guide rail and which can be tilted with the latter, and having a pressure application spindle with a pressure piece, which pressure application spindle is displaceably arranged on the sliding arm so that a compressive force can be exerted on a workpiece between transverse arm and sliding arm, a box-like attachment member is provided for the sliding arm, which provides a substantially flat abutment surface for a workpiece, and is so constructed that it can be pushed on the pressure piece of the sliding arm so that the attachment member is held on the sliding arm and a compressive force can be exerted by the attachment member on a workpiece via the pressure application spindle, and wherein the attachment member comprises at least two mutually spaced guide recesses via which it is displaceably mounted on the guide rail.

38 Claims, 7 Drawing Sheets

ARM CLAMP

The present disclosure relates to the subject matter disclosed in German application No. 101 58 005.3 of Nov. 22, 2001, which is incorporated herein by reference in its entirety and for all purposes.

BACKGROUND OF THE INVENTION

The invention relates to an arm clamp having a guide rail, on which a transverse arm is fixed, having a sliding arm which is displaceable on the guide rail and which can be inclined against the latter, and having a pressure application spindle with a pressure piece, which pressure application spindle is displaceably arranged on the arm bracket so that a pressure force can be exerted on a workpiece between transverse arm and sliding arm.

Such arm clamps are known from the prior art, especially in the form of screw clamps. For example, such arm clamps are shown in the form of die cast clamps in the catalog of Bessey & Sohn GmbH & Co. for the year 1998.

SUMMARY OF THE INVENTION

With the arm clamp in accordance with the present invention, the utility is increased. This is achieved via a box-like attachment member provided for the sliding arm, which provides a substantially flat abutment surface for a workpiece, and is so constructed that it can be pushed on the pressure piece of the sliding arm so that the attachment member is held on the sliding arm and a pressure force can be exerted by the attachment member on a workpiece via the pressure application spindle, and wherein the attachment member comprises at least two mutually spaced guide recesses via which it is displaceably mounted on the guide rail.

As a result of the box-like attachment member, which can be placed on the sliding arm (or on which the sliding arm can be placed) without the use of additional parts such as rivets or screws, a known arm clamp can be converted to what is referred to as a body clamp, which provides a large flat abutment surface for a workpiece. The body clamp produced in this manner then possesses, by comparison with known arm clamps, a larger flat clamping surface, this in turn being precisely guided on the rail via the mutually spaced guide recesses so that the flat abutment surface, independently of the position of the sliding arm on the guide rail, is oriented, in particular, at right angles to the latter. Furthermore, as a result, the abutment surface produces an alignment effect and can hold the workpiece at the correct angle.

By means of such a body clamp, for example, delicate frame constructions can be effectively clamped, extremely narrow abutment surfaces can be reliably clamped or rounded surfaces can be subjected to contact pressure.

A body clamp is known, for example, from EP 0 010 260 B1. A body clamp produced by the company Gross+ Froehlich is known under the name "Gross & Stabil". In contrast to this body clamp from the prior art, however, the body clamp according to the invention can be produced in a simple manner from a known arm clamp by the addition of the attachment member. Similarly, the body clamp thus produced can be converted again in a simple manner to the generic arm clamp. Correspondingly, the arm clamp according to the invention with an attachment member, in other words the body clamp, can be produced in a simple manner.

Because the pressure piece of the pressure application spindle can be pushed onto the attachment member or vice versa (the attachment member is brought on the pressure piece), and no further parts are therefore needed for fixing, and in addition the attachment member is guided via guide recesses on the sliding rail, no additional metal parts, in particular, are needed to fix the sliding arm on the attachment member or to guide the attachment member on the guide rail. As a result, in turn, the arm clamp according to the invention can be constructed with little weight ("lightweight" body clamp).

Provision is made, in particular, for the pressure piece of the sliding arm to be able to be pushed on when the sliding arm is drawn off from the guide rail, in other words the attachment member can be placed on the sliding arm.

Advantageously, a guide recess embraces the guide rail, in order thus to achieve precise guidance of the attachment member and thus of the flat abutment surface thereof on the guide rail, without it being necessary to provide, for example, sliding rollers or the like.

Advantageously, a guide recess is formed in an end wall forming the abutment surface and an additional guide recess is also formed in an end wall of the attachment member, which is a terminal wall of the end element. As a result of this, the input of material to construct the guide recesses can be minimized, thus minimizing the weight of the arm clamp according to the invention.

In particular, the attachment member is of one-piece construction. It can then, for example, be produced integrally with all its functional parts by an injection molding process. For assembly (in other words, for fixing the sliding arm on the attachment member), again, no additional parts are needed, so that not only is the input of material reduced but assembly can proceed rapidly and cost-effectively. In particular, it then becomes possible for a user himself to convert his generic arm clamp into a body clamp and vice versa.

It is very particularly advantageous if the attachment member comprises a push-in mounting for the pressure piece in order to block the movement thereof away from the attachment member parallel to the guide rail. If the attachment member is then placed on the guide rail with the sliding arm, then although the sliding arm may be tilted relative to the guide rail, in order thus to achieve an inclined position and secure a clamping position, the pressure piece cannot be drawn off from the attachment member (unless the attachment member itself moves with it). As a result, the sliding arm can be held on the attachment member or, conversely, the attachment member can be held on the sliding arm in a simple manner, so that a force can be exerted via the pressure application spindle by means of the attachment member on a workpiece, but the fixing of these two parts is possible in a simple manner, so that no additional parts are required for the fixing. In particular, the push-in mounting can be produced integrally with the production of the attachment member, for example by an injection molding procedure.

It is, moreover, very particularly advantageous if the pressure piece is arranged on the pressure application spindle so that the sliding arm with the pressure piece in the push-in mounting can be inclined against the guide rail. In this case, a fixation can be achieved in a simple manner between attachment member and sliding arm, and the sliding arm remains capable of being inclined (tilted).

Expediently, the push-in mounting is so constructed that the pressure piece can be inserted therein transversely to a perpendicular of the abutment surface of the attachment member. The fixing of the pressure piece to the attachment member can then be carried out in a simple manner, without additional parts being required.

In particular, the push-in mounting is formed by a retaining ledge, which provides an abutment surface for the pressure piece, so that the latter abuts against the retaining ledge when it is moved away from the attachment member. A movement of the pressure application spindle with the pressure piece is then converted into a movement of the attachment member, or a compressive force can be exerted on a workpiece via the attachment member.

Advantageously, in this case, the retaining ledge is formed in an interior space of the attachment member, so that, when the pressure piece is inserted into the push-in mounting and the pressure application spindle is actuated, a workpiece lying on the flat abutment surface can be subjected to the action of pressure.

The conversion of the generic arm clamp into a body clamp can be achieved in a simple manner if the attachment member is held on a sliding arm without the use of additional parts. In this case, the attachment member is retained on the sliding arm, and specifically on the pressure piece thereof, solely via the push-in mounting or, conversely, the sliding arm is retained on the attachment member solely via the push-in mounting.

It is advantageous if the attachment member is of L-shaped construction, having a longitudinal portion and a transverse portion, the guide recesses being formed in the longitudinal portion. One effect of this is the provision of a guide bearing, in order to achieve precise guidance of the attachment member on the guide rail, as a result of which, in turn, the flat abutment surface is oriented precisely and preferably at right angles to the guide rail. Fixing between the attachment member and the sliding arm can also be achieved via the transverse portion and the longitudinal portion in a simple manner by means of a push-in mounting.

Advantageously, in this case, a push-in mounting for the pressure piece is formed on the transverse portion.

It is advantageous if the longitudinal portion is provided, between mutually spaced side walls, with a downward aperture and an upward aperture, so that the sliding bracket can be inserted via the upper aperture in a direction lying between the upper aperture and the lower aperture and the pressure piece can be introduced in the opposite direction into a push-in mounting. In this case, the sliding arm, when it is drawn off from the guide rail, can be positioned relative to the attachment member in such a way that its pressure piece can be inserted into the push-in mounting. As a result, the assembly of the attachment member is greatly simplified.

The weight of the body clamp can be kept low, if the attachment member is produced from a plastic, such as a polyamide.

In order to provide a large flat clamping surface, the latter advantageously extends at least from the pressure piece to the guide rail and advantageously beyond the guide rail. As the attachment member encompasses the sliding bracket in the manner of a box, the extent of the attachment member at its flat abutment surface is also greater than a width of the sliding arm and, in particular, a maximum width of the sliding arm.

It is additionally advantageous if the flat abutment surface is oriented substantially perpendicularly to the guide rail. As a flat abutment surface has an alignment effect, a workpiece can thereby be retained at a right-angle.

To secure this alignment effect, the attachment member is advantageously guided substantially without tilt on the guide rail.

It is also advantageous if the sliding arm is guided on the guide rail between mutually spaced guide recesses of the attachment member. In this case, it can be constructed without an offset and, by corresponding walls of the attachment member, an abutment surface is also provided which blocks the relative movement between pressure application spindle and attachment member.

It is very particularly advantageous if the guide rail is provided with serrations and a guide bearing of the sliding arm is provided with a serrated portion facing the serrated portion of the guide rail. As a result, canting can be achieved between the sliding arm and the guide rail in order to secure a clamping position of the attachment member.

Advantageously, in this case, the guide rail is produced from steel, so that it possesses appropriate hardness.

It may be advantageous if the sliding arm is produced from zinc, in order to achieve a good hooking connection between a canted sliding arm and the guide rail, as a sliding arm of this type engages well into the steel material of the guide rail.

In order to form a body clamp, it is particularly advantageous if an additional attachment member is provided for the transverse arm in order to provide a substantially flat abutment surface. Depending on the orientation of the attachment member connected to the sliding arm, this flat abutment surface is in this case facing either toward or away from the other flat abutment surface. In the former case, a clamping tool is produced, while in the latter case a spreading tool can be produced. As a result of the corresponding additional attachment member, a large flat clamping surface can in turn be achieved which, in particular, is precisely fixed on the guide rail. It possesses the advantages previously described in connection with the attachment member for the sliding arm.

In particular, in this case, the additional attachment member is again of one-piece construction.

In order to be able to convert a generic arm clamp into a body clamp, the additional attachment member here can advantageously be pushed onto the transverse arm. It is also advantageous if the additional attachment member can be fixed to the transverse arm with non-positive fitting. In order to provide a flat clamping surface, it is then merely necessary for the additional attachment member to be pushed onto the transverse arm and it is then retained thereon with non-positive fitting. Correspondingly, it can then also be drawn off again by a certain expenditure of force. The flat abutment surface at the transverse bracket can thus be produced in a simple manner.

It is also advantageous if a releasable locking device is arranged on the guide rail to block the removal of the attachment member and sliding arm. This prevents the attachment member and sliding arm from being able to become detached from the guide rail. As the locking device is of releasable construction, however, it can be removed specifically in order to allow drawing-off. As a result, it is possible to turn the attachment member in order to convert a clamping tool into a spreading tool and vice versa. On the other hand, by drawing off the sliding arm with the attachment member, it is also possible to release the attachment member from the sliding arm or, conversely, to fix the attachment member to the sliding arm in order to convert a body clamp into a generic arm clamp and vice versa.

It is further advantageous if an attachment member comprises an abutment surface having a normal direction transverse to the guide rail via which the arm clamp can be set down on a base. This can be advantageous for numerous applications, as in this case the bracket clamp can directly form a base or a support for a workpiece.

It is very particularly advantageous if a support for fixing to the guide rail is provided at or in the vicinity of an end remote from the transverse arm, in order to provide an abutment surface to support the arm clamp on a base. As a result, a tilting of the arm clamp relative to the transverse arm with the additional attachment member is prevented, if, correspondingly, the support is adapted to the additional attachment member and/or to the attachment member for the transverse arm.

Provision is made, in particular, for the support to be constructed as a pull-off guard for the attachment member and the sliding bracket, in which case the support can be releasably fixed to the guide rail.

It is advantageous if a support (holding structure) is provided for fixing the pressure piece with regard to the attachment member so as to block the movement of the pressure piece away from the attachment member. Also, with this support the movement of the attachment member and the movement of the pressure piece are coupled, wherein the movement is actuated via the pressure application spindle.

In particular, the support is arranged on the attachment member. Thus, "conventional" pressure pieces can be used and be fixed in a simple manner on the attachment member.

The support can be formed as a push-in support for the pressure piece or it can comprise one or several fixing elements which are separated from the attachment member but are fixable on the attachment member. In the latter case, the fixing elements can be pushed on the pressure piece at least partially so as to fix the pressure piece with regard to the attachment member.

The description of a preferred embodiment which follows serves, in conjunction with the drawings, to provide a detailed explanation of the invention.

DETAILED DESCRIPTION OF THE INVENTION

Figure 1:
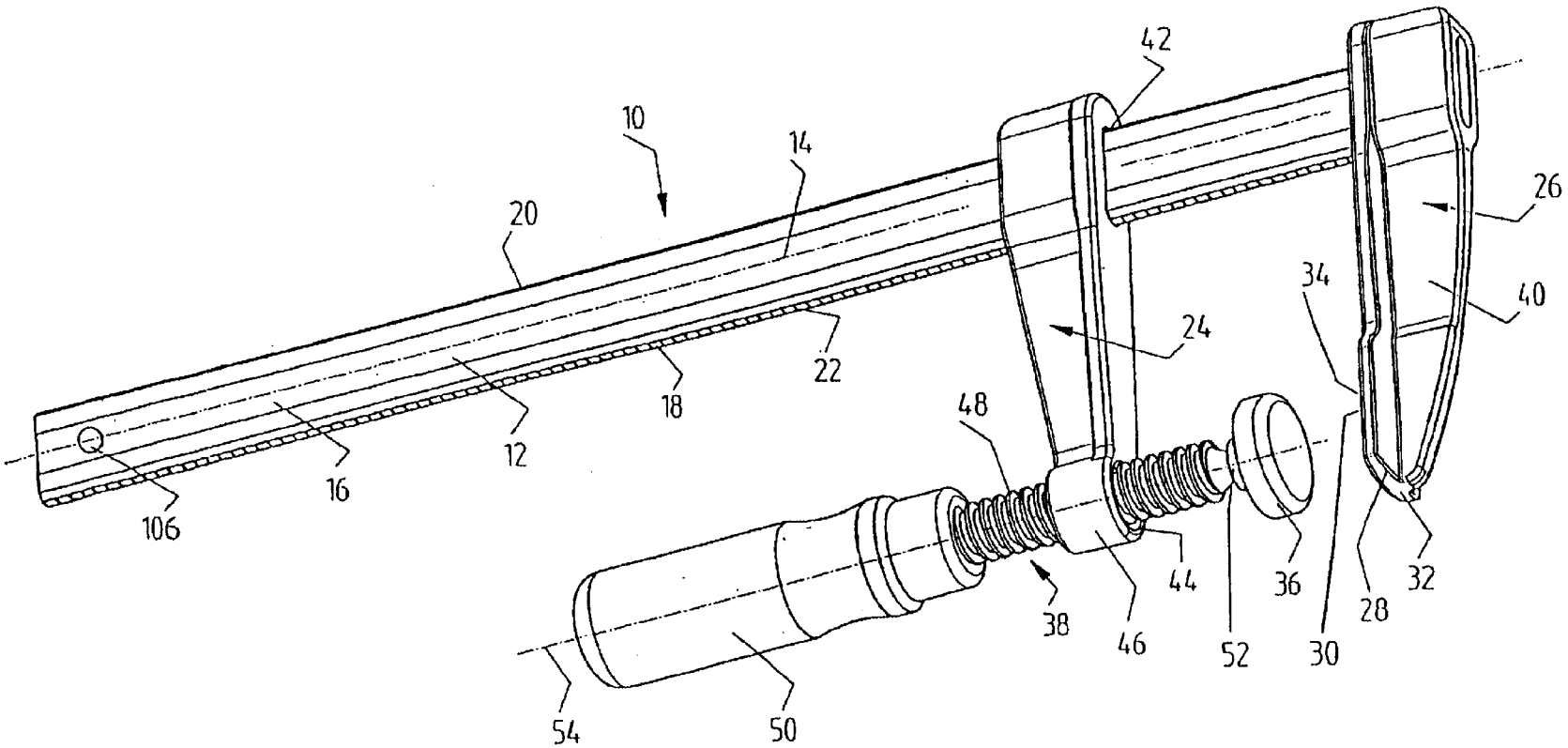
Fig. 1 (Prior Art)
FIG. 1 shows a perspective view of an arm clamp in the form of a screw clamp, known from the prior art.

An example of embodiment of a known arm clamp, which is designated as a whole in FIG. 1 by 10, comprises a guide rail 12 which extends in a longitudinal direction 14.

The guide rail may, as shown in FIG. 1, be profiled with opposed central depressions 16, so that the corresponding profile has approximately the shape of a capital I.

Preferably, the guide rail 12 is produced from steel and provided on opposite edge surfaces 18 with a serrated portion 22 extending over the longitudinal direction 14. A sliding arm 24 can then hook into this serrated portion 22 when inclined relative to the guide rail 12.

A fixed transverse arm 26 is arranged at one end of the guide rail 12 and extends transversely, and in particular perpendicularly, to the guide rail 12. This transverse arm 26 comprises an abutment flange 28, which has a substantially flat abutment surface 30 facing the sliding arm 24. This abutment surface 30, in turn, is widened in the vicinity of an upper end 32 of the transverse arm 26, this widened surface 34 being oriented toward a pressure piece 36 of a screw spindle 38 as a pressure application spindle.

To support the abutment flange 28, the transverse arm 26 is provided with a curved support part 40, the support part 40 and abutment flange 28 being, in particular, of one-piece construction.

The sliding arm 24 is displaceably guided on the guide rail 12, relative to which it is arranged transversely and, in particular, without offset. As a guide bearing, it comprises a continuous guide recess 42 in the longitudinal direction 14, which is so dimensioned that the sliding arm 24 is both displaceable on the guide rail 12 and capable of inclination thereon, in order to enable the sliding arm 24 to be fixed on the guide rail 12.

A serrated portion (not shown in the drawings) is formed on the guide recess 42, facing the edge surfaces 18 and 20 of the guide rail 12, in order to assist the hooking connection between sliding arm 24 and guide rail 12 during canting. Preferably, in this case, the sliding arm 24, which is in particular of one-piece construction, is produced from zinc, in order to achieve good engagement into the steel guide rail 12 when canted and thus in turn improve the hooking engagement when inclined (tilted). The serrated portion on the guide bearing 42 is then formed, on first tensioning, as it were as a mirror-image of the serrated portion 22.

Seated at the upper end of the sliding arm 24 is a threaded flange 46, provided with an internal thread 44, in which the pressure application spindle 38 is displaceably guided. The latter comprises an external thread 48 for this purpose, which is, in particular, a trapezoidal thread; this trapezoidal thread 48 engages into the internal thread 44 of the threaded flange 46 of the sliding arm 24.

The pressure application spindle 38 is provided with a handle 50, for example of wood, via which the pressure application spindle 38 can be turned. The pressure piece 36 can be displaced relative to the sliding arm 24 by appropriate turning.

The pressure piece 36 in this case is fixed to a leading end 52 of the pressure application spindle 38 in such a way that it can be tilted relative to a longitudinal direction 54 of the pressure application spindle 38, this tilting being possible in all transverse directions. This possibility of tilting can be achieved by an appropriate construction of the fixing, with play, a tilting angle of, for example, the order of magnitude of 30° being permitted.

The longitudinal direction 54 of the pressure application spindle 38, which determines the direction of displacement of the pressure application spindle 38 relative to the sliding arm 24, is substantially parallel to the longitudinal direction 14 of the guide rail 12.

The arm clamp 10 functions as follows:

A pressure force can be exerted via the pressure application spindle 38 on a workpiece between the pressure piece 36 and the surface 34. As a result of the forces of reaction arising therefrom, the sliding arm 24 is canted relative to the guide rail 12, so that it is fixed on the guide rail 12 and the clamping position (pressure application position) is thus secured.

The serrated portion on the guide bearing 42 of the sliding arm 24 is matched to the serrated portion 22 of the guide rail 12 and is so constructed that the attachment member 58 with the sliding arm 24 can be slid toward the transverse arm 26, while, for displacement in the opposite direction, the sliding arm 24 has to be tilted slightly away from the attachment member 58; this can be achieved in that the handle 50 is held upward, away from the guide rail 12.

Figure 2:
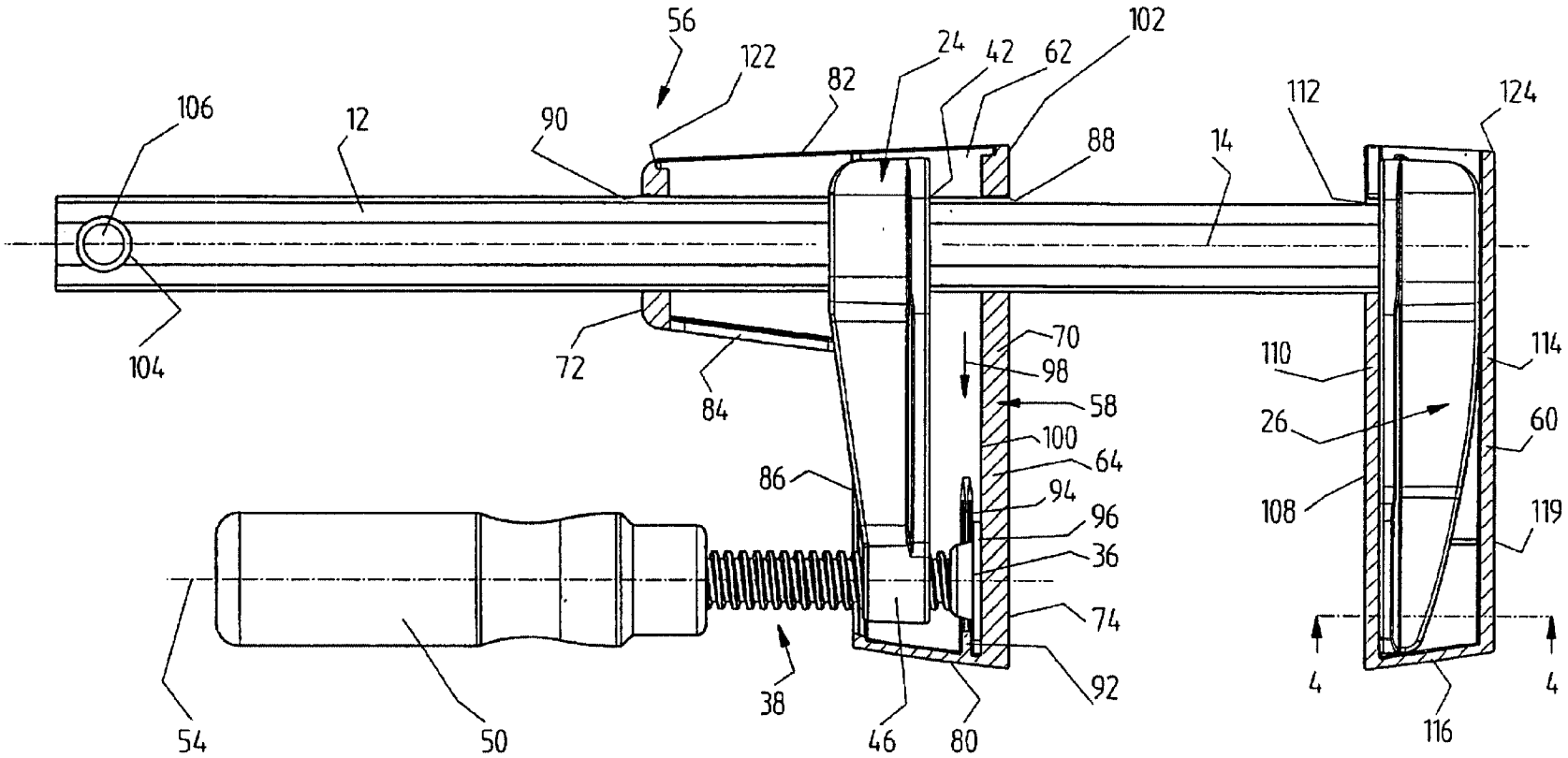
FIG. 2 shows a lateral view, in section, of the arm clamp in accordance with FIG. 1, which is provided according to the invention with pushed-on attachment members on the arms.

According to the invention, the arm clamp in accordance with FIG. 1 can now be rigged to form a body clamp:

An embodiment of such a body clamp is designated as a whole, in FIG. 2, by 56. This has been derived from the arm clamp 10 in that the sliding arm 24 has been provided with an attachment member 58 and the transverse arm 26 with an additional attachment member 60.

The attachment member 58 is of box-like construction, having a longitudinal portion 62, which is oriented along the guide rail 12, and a transverse portion 64, which is oriented transversely thereto.

The longitudinal portion 62 comprises opposite side walls 66, 68 (FIG. 3), which are connected to one another at their ends via respective end walls 70, 72. The end wall 70, which faces the transverse arm 26, in this case simultaneously forms an end wall for the transverse portion 64 and, facing the transverse arm 26, forms a flat abutment surface 74 for a workpiece, which is oriented transversely and, in particular, perpendicularly to the longitudinal direction 14 of the guide rail 12. A normal direction of this abutment surface 74 is thus substantially parallel to the longitudinal direction 14 of the guide rail 12.

The transverse portion 64 likewise comprises opposite side walls 76, 78, which are connected to one another by an upper lid wall 80.

The side walls 76 and 78 here are continuations of the side walls 66 and 68 of the longitudinal portion 62 into the transverse portion 64. The attachment member 58 is thus of one-piece construction.

The longitudinal portion 62 of the guide rail 12 points to a lower aperture 82, which is formed between lower ends of the side walls 66 and 68.

Moreover, the longitudinal portion 62 comprises, facing the guide rail 12, an upper aperture 84, which is formed between corresponding upper ends of the side walls 66 and 68 outside the side walls 76 and 78 of the longitudinal portion 62.

The transverse portion 64 is provided with an aperture 86, which is arranged facing away from the end wall 70 forming the flat lateral surface 74.

Via the aperture 86, the pressure piece 36 of the pressure application spindle 38 can be introduced into the box-like attachment member 58. Via the apertures 82 and 84, a movement inserting the pressure piece 36 in a push-in mounting arranged in an interior space of the transverse portion 64 can be performed, as will be described below.

Mutually spaced guide recesses 88, 90 in the form of wall perforations are formed in the end walls 70 and 72 of the longitudinal portion 62 and are aligned flush with one another. These guide recesses have, in this case, been produced, in particular, integrally during the production of the attachment member 58, for example by means of injection molding.

A guide recess 88 is, for example, as a first approximation, of rectangular construction and adapted, in particular, to a profile of the guide rail 12. When the attachment member 58 is placed on the guide rail 12, the guide recesses 88, 90 engage around the guide rail 12, so that the attachment member 58 is guided without tilting on the guide rail 12. As a result, in turn, the flat abutment surface 74 is aligned with a defined orientation to the guide rail 12, thus ensuring that the abutment surface 74, independently of the position of movement of the attachment member 58 on the guide rail 12, is oriented substantially perpendicularly thereto.

The attachment member 58 is provided with a push-in mounting 92, which is formed, in particular, as one piece on the side walls 76 and 78 and the lid wall 80 and therefore as one piece on the attachment member 58. The sliding arm 24 can be retained via this push-in mounting 92, by means of its pressure piece 36, on the attachment member 58, in such a way that the movement of the pressure piece 36 in the longitudinal direction 14 away from the attachment member 58 is blocked. However, the canting ability of the sliding arm 24 on the guide rail 12 is not blocked. This can be achieved, in particular, by the tilting ability of the pressure piece 36 relative to the pressure application spindle 38, as described above, the push-in mounting 92 then being constructed in such a way that the tilting ability is substantially not blocked.

The push-in mounting 92 comprises, in an alternative embodiment, which is shown in FIG. 2, a ledge-like edge element 94, which is at a distance from the inside of the end wall 70, is arranged on the side walls 76 and 78 and is likewise arranged on the lid wall 80. Between this edge element 94 and the end wall 70, a widened pressure plate 96 of the pressure piece 36 can be inserted.

The edge element 94 comprises a first region, which is arranged on the side wall 76, a second region, which is arranged on the side wall 78, and a circular region, which connects the first region and the second region to one another. The circular region is in this case constructed on a circular lid wall 80, so that the likewise circular pressure plate 96 can be laid in place accordingly.

The first region and the second region of the edge element 94 are mutually spaced in such a way that the pressure, piece 36 can enter this same intermediate region outside the pressure plate 96.

The edge element 94 with its first region and its second region is, moreover, so dimensioned, and in particular has such a transverse length in vertical orientation to the guide rail 12, that when the attachment member 58 is released from the guide rail 12, the pressure piece 36 can be inserted in a transverse direction 98, in particular perpendicularly to the longitudinal direction 54, the sliding arm being introduced through the aperture 84 counter to the transverse direction 98 into the longitudinal portion 62 of the attachment member 58 and pushed through the aperture 82, and subsequently, abutting against an inside 100 of the end wall 70, the pressure piece 36 with its pressure plate 96 is displaced in the transverse direction 98, so that the pressure plate 96 is introduced into the push-in mounting 92, in other words between the edge elements 94 and the end wall 70.

Figure 3:
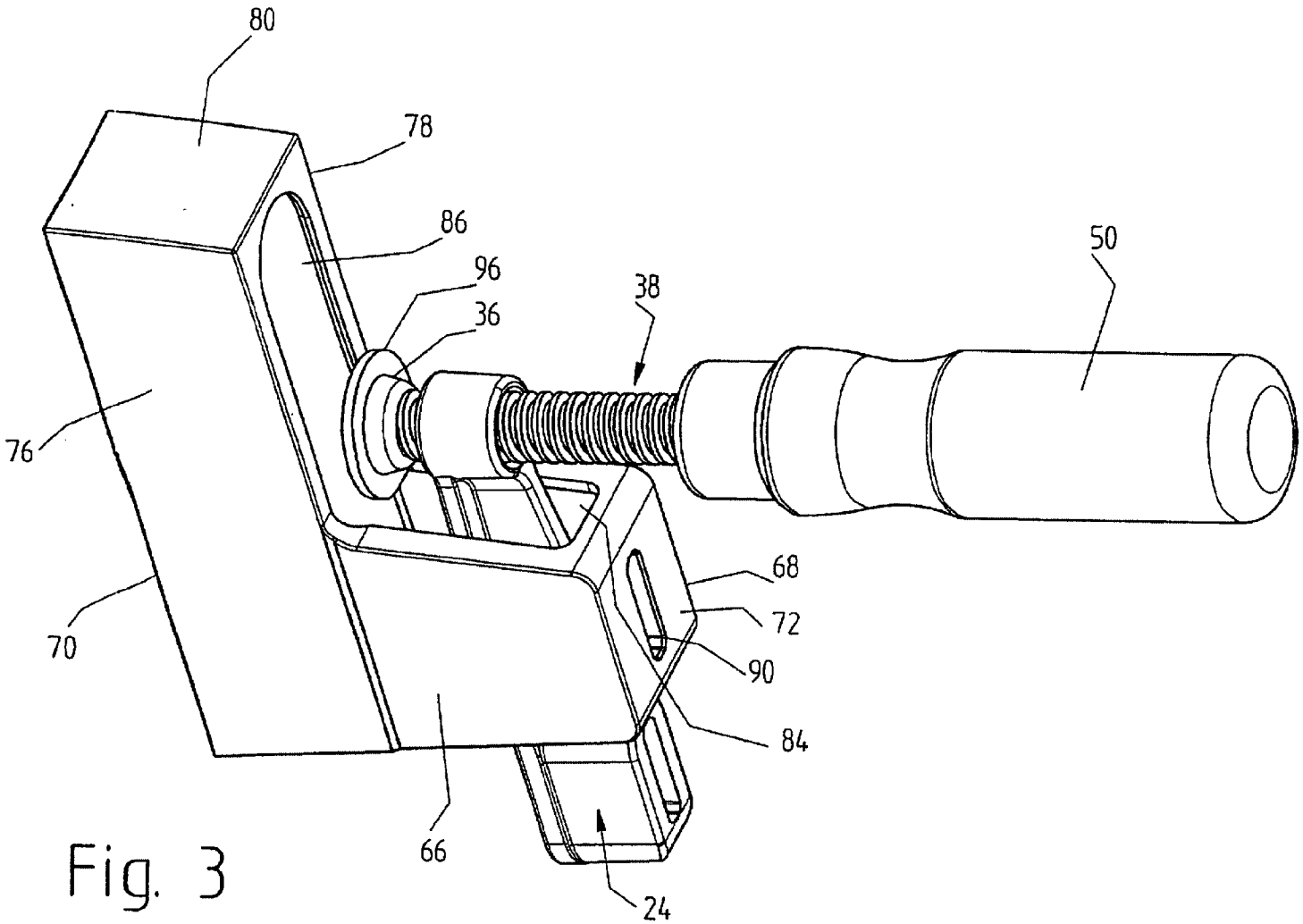
FIG. 3 shows an illustration of a partial step of pushing an attachment member onto a sliding arm with the sliding arm removed.

A corresponding intermediate step is shown in FIG. 3, in which the sliding arm 24 is pushed through the aperture 84 and the aperture 82, projecting below the aperture 82. As a result, the pressure piece 36 is positioned below the push-in mounting 92 and, by a movement in the longitudinal direction 54, the pressure piece 36 can be laid against the end wall 70 through the aperture 86 and then pushed in the transverse direction 98 into the push-in mounting.

This combination of attachment member 58 and sliding arm 24 can then in turn be pushed onto the guide rail 12, when the guide bearing 42 of the sliding arm 24 is aligned flush with the guide recesses 88, 90.

The box-like attachment member 58 according to the invention, which is of one-piece construction, can be fixed, without the use of additional parts such as screws or rivets, to the sliding arm 24 via its pressure piece 36, in such a way that the attachment member 58 can be moved on the guide rail 12 via the pressure application spindle 38 in order thus to be able to clamp a workpiece which rests on the abutment surface 74. The canting of the sliding arm 24 to secure the clamping position is not obstructed here by the mounting of the sliding arm 24 on the attachment member 58.

The attachment member can thus be connected to the sliding arm 24 and also released again therefrom by simple production engineering methods.

With the attachment member 58 placed on the guide rail 12 and the sliding arm 24 being guided, the sliding arm with its guide recess 42 is arranged between the guide recesses 88 and 90 of the attachment member 58, the position being dependent on the position of displacement of the pressure application spindle 38. The result of this is, first, to ensure that the flat abutment surface 74 is oriented substantially perpendicularly to the guide rail 12, that the attachment member 58 is displaceable via actuation of the pressure application spindle 38 and a pressure can be exerted on a workpiece, but secondly also to ensure that the sliding arm 24 can be canted relative to the guide rail 12 in order to be able to secure a pressure application position.

The flat abutment surface 74 here extends transversely to the guide rail 12 at least in one region, at least from an upper end of the pressure plate 96 to the guide rail 12. In the example of embodiment shown in FIG. 2, the flat abutment surface 74 also extends with one part-region 102 beyond the guide rail 12, so that a corresponding transverse length of the abutment surface 74 is greater than a distance between a lower lateral end of the guide rail 12 and an upper end of the pressure plate 96.

The guide rail 12 comprises, in the vicinity of its end remote from the transverse arm 26, a through aperture 104, into which a releasable plug element 106 can be inserted, in order to form a pull-off guard for the attachment member 58 with the sliding arm 24. This plug element 106 is preferably produced from a plastic and so constructed that it is retained in the aperture 104 by pressure fitting. As a result, this plug element 106 can be released in a simple manner from the guide rail 12.

This makes it possible to push the attachment member 58 and the sliding arm 24 onto the guide rail and, if appropriate, when the flat abutment surface 74 is not required, to draw off the attachment member 58 and the sliding arm 24 from the guide rail and push the sliding arm 24 on again without the attachment member 58.

The additional attachment member 60 is so constructed that it can be pushed onto the transverse arm 26. In particular, it is so constructed in this case that, for the transverse arm 26, a flat abutment surface 108 for a workpiece is provided, which is oriented toward the flat abutment surface 74 of the attachment member 58 and is also oriented transversely, and in particular substantially perpendicularly, to the guide rail 12 (in other words, in a direction normal to the surface, which is substantially parallel to the longitudinal direction 14).

The additional attachment member 60 comprises a plug-on slit 112 in a side wall 110 forming the flat abutment surface 108, whereby the additional attachment member 60 can be pushed by the guide rail onto the transverse arm 26.

Figure 4:
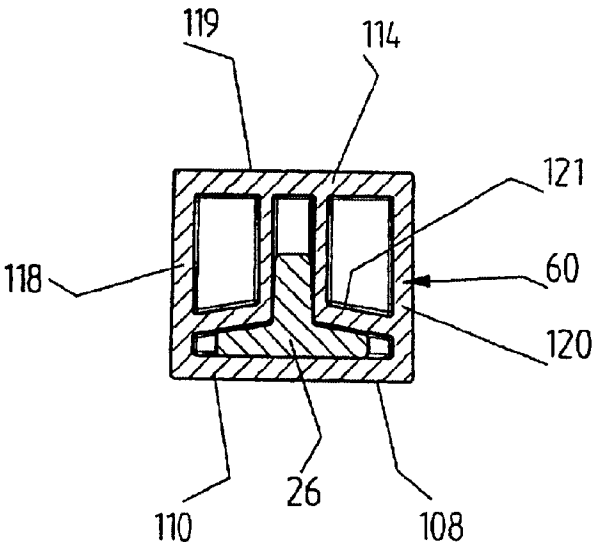
FIG. 4 shows a view in section along the line 4—4 in accordance with FIG. 2 of a fixed transverse arm with attachment member.

The additional attachment member 60 is formed by means of the side wall 110, an opposite side wall 114 and a lid wall 116 (cf. also FIG. 4). Corresponding transverse walls 118 and 120 are arranged between the side walls 110 and 114.

In particular, the side wall 114 here comprises a substantially flat outer surface 119, in order to provide a flat abutment surface in particular for spreading operations.

The additional attachment member is open toward its lower end, so that it can itself be pushed onto the transverse arm 26.

The additional attachment member 60 is so divided in its interior space, by means of interior walls 121, that the transverse arm 26 can be pushed in with its abutment flange 28 and is retained by clamping against these interior walls 121.

The interior walls 121 are constructed to match the transverse arm 26 in such a way, and the additional attachment member 60 is produced from such an elastic material, that the additional attachment member can be pushed onto the transverse arm 26 and is retained thereon with non-positive and, in particular, clamping fitting.

Advantageously, the attachment member 58 and the additional attachment member 60 are produced from a plastic, such as a polyamide. In particular, the additional attachment member 60 is of one-piece construction. This also has the advantage that the body clamp 56 thus produced is of relatively light weight.

Provision may be made for the attachment members 58 and 60 themselves to provide abutment surfaces 122 and 124 (see FIG. 2), by means of which the body clamp 56 can be placed on a base. In particular, these are flat abutment surfaces.

Figure 5:
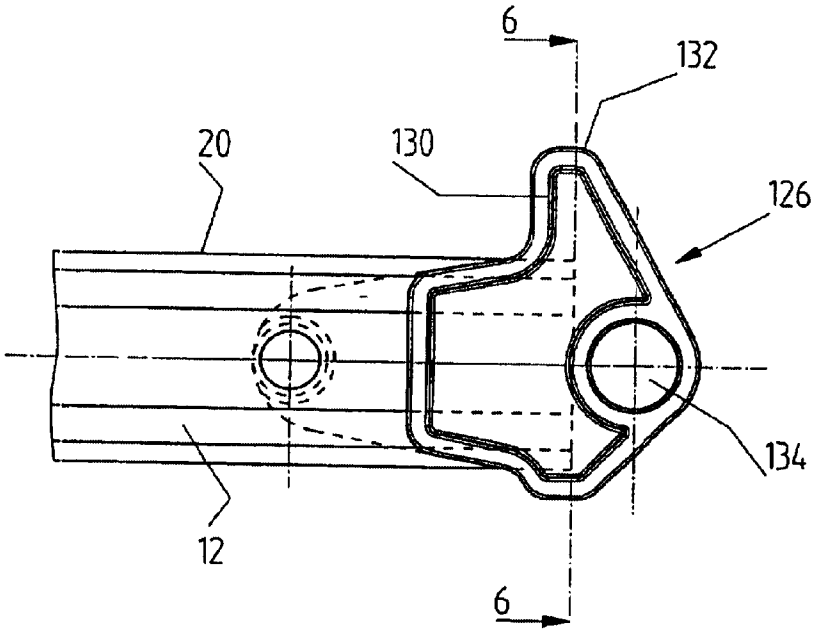
FIG. 5 shows a lateral view of a support, which is fixed to one end of a guide rail of the arm clamp.

In order to provide better support for the body clamp 56 and, in particular, to support it in the region of its end remote from the transverse arm 26, a support 126 may then be provided (FIG. 5), which can be plugged on to the appropriate end of the guide rail 12 and comprises an extension away from the guide rail 12, which substantially corresponds to the extent of the additional attachment member 60 away from the guide rail and, optionally, of the attachment member 58, again away from the guide rail 12. As a result, the body clamp can be supported on a base at least between the support 126 and the additional attachment member 60, without the base tilting relative to the additional attachment member 60.

Figure 6:
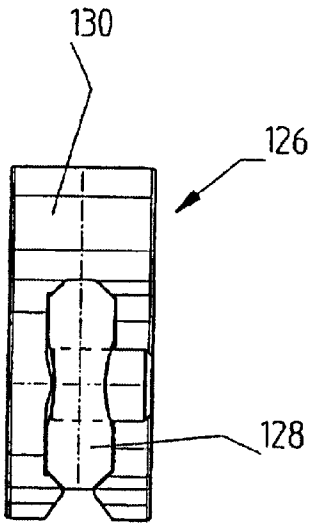
FIG. 6 shows a view in section along the line 6—6 in accordance with FIG. 5.

For this purpose, for example, the support 126 comprises a recess 128 adapted to the guide rail 12 (FIG. 6), via which it can be plugged onto that same guide rail 12. The recess 128 in this case is of such a depth, or is provided with an appropriate barrier, that the guide rail cannot be pushed through the support 126.

As described above, the support 126 is provided with a spacer 130, which is so dimensioned that the distance of its end 132 from the end surface 20 of the guide rail 12 substantially corresponds to the distance from the abutment surface 124 of the additional attachment member 60 to the same end surface 20 of the guide rail 12.

In particular, the support 126 is so constructed that it is retained in a releasable manner by pressure fitting on the guide rail 12. It is then simultaneously constructed as a pull-off guard for the sliding bracket 24 with the attachment member 58, so that when the support 126 is released the sliding arm 24 with the attachment member 58 can be pushed onto the guide rail and, with the support 126 fixed, is secured against pulling-off thereof.

Provision may be made for the support 126 to be provided with an eyelet 134, in order to facilitate the release of a support 126 fixed on the guide rail 12, in order to have improved access for the application of force. (For example, a nail can be pushed into this eyelet 134, or a wire, in order thus to draw the support 126 off from the guide rail 12.) This eyelet 134 can also be used to store (hang up) the bracket clamp according to the invention.

The body clamp 56 according to the invention can be produced in a simple and cost-effective manner from a fully operational arm clamp 10. Moreover, it is possible, in a simple manner, to convert the arm clamp 10 to the body clamp 56 and vice versa.

The body clamp 56 can be employed in many ways, the flat abutment surfaces 74 and 108, in particular, permitting the large-area clamping of workpieces. The abutment surfaces in turn are precisely guided on the guide rail 12 (abutment surface 74) or fixed in a precisely aligned manner (abutment surface 108). The corresponding canting surfaces thus also have an alignment effect and hold the workpiece at a correct angle.

Since large abutment surfaces are provided via the attachment members 50 and 60, workpieces with very narrow abutment surfaces can also be reliably clamped. For example, contact pressure can also be applied to rounded surfaces.

Figure 7:
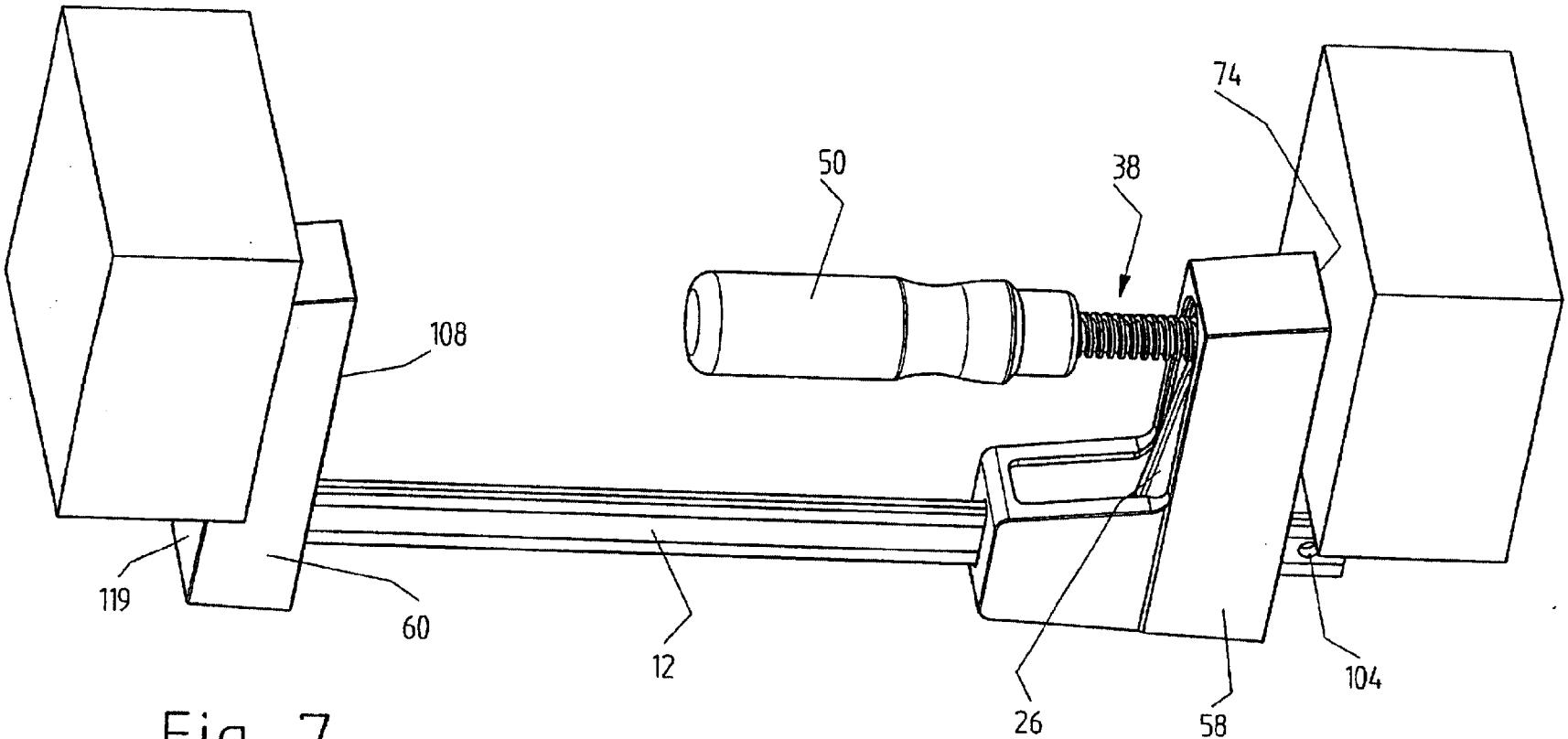
FIG. 7 shows a diagrammatic view of the use of the arm clamp according to the invention, in accordance with FIG. 2, as a spreading tool.

As shown in FIG. 7, the body clamp 56 according to the invention may also be used as a spreading tool. For this purpose, the attachment member 58 with the transverse arm 26 is placed on the guide rail in such a way that its abutment surface 74 is not facing the abutment surface 108 of the additional attachment member 60 but is oriented away from it.

As a result of the simple possibility of drawing the attachment member 58 with the sliding arm 26 off the guide rail 12, the body clamp 56 can thus be converted in a simple manner from a clamping tool to a splaying tool and vice versa. As previously mentioned above, the body clamp 56 can also be converted in a simple manner from a "conventional" screw clamp to a body clamp and vice versa.

Figure 8:
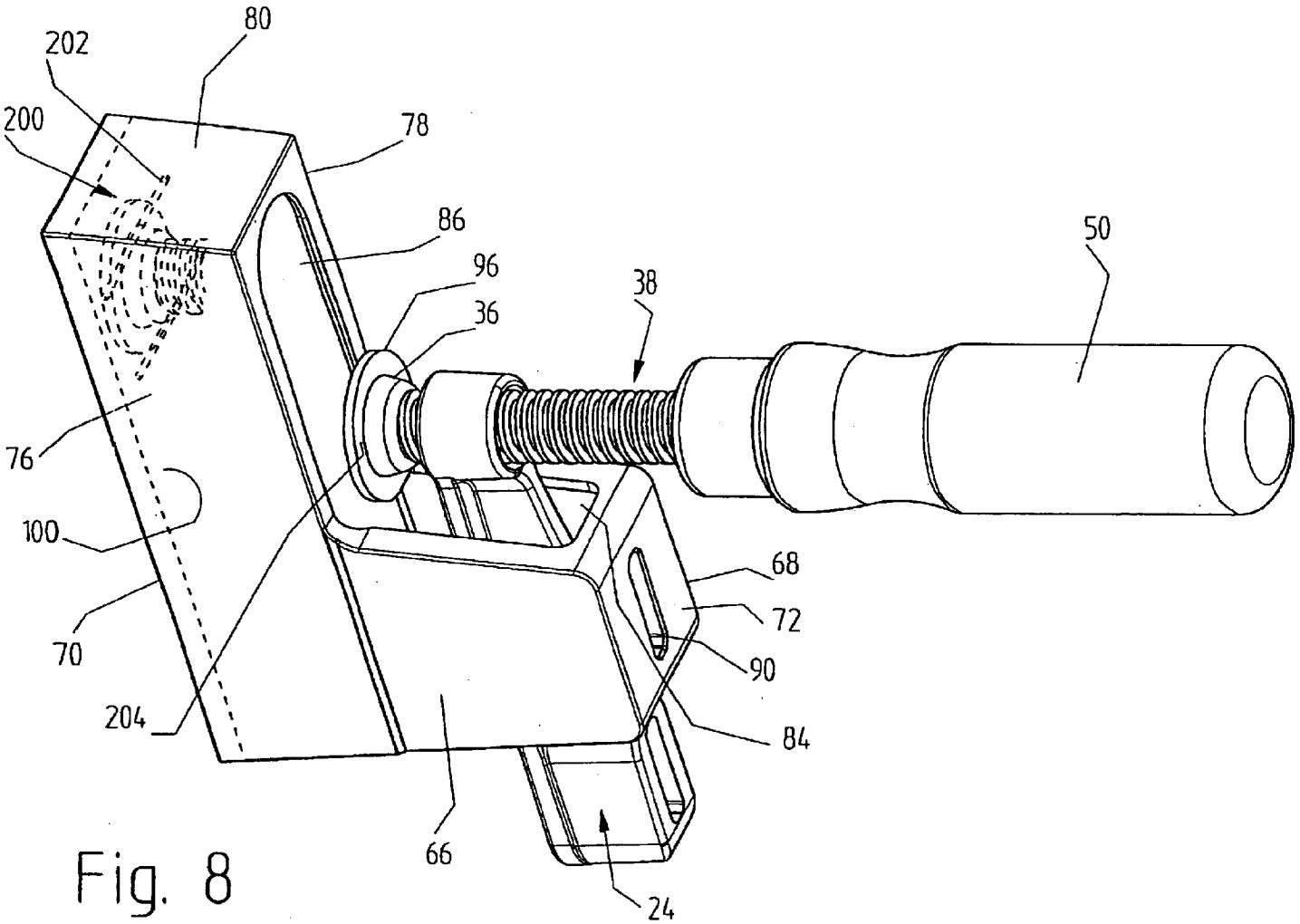
FIG. 8 a further embodiment with a partial view of a sliding arm.

In a further embodiment, as shown in FIG. 8, a support 200 as holding structure is provided for fixing the pressure piece 36 of the sliding arm 24 on the attachment member 58; this support 200 is formed via fixing elements 202 which are separate from the attachment element 58. An example for such a fixing element 202 is a pin or bolt; the pin or bolt is fixable on the attachment member in a direction transverse to the longitudinal direction 14 of the guide rail 12 between opposite side walls 76, 78.

For establishing the fixation the pressure piece 36 with pressure plate 96 is set on the inside 100 of the attachment member 58; afterwards the fixing elements 202 are pushed on and are pushed over a backside 204 of the pressure plate 96, wherein said backside 204 is opposite to the inside 100 of the attachment member 58. Thus, the movement of the pressure piece 36 away from the inside 100 of the attachment member 58 is blocked.

In particular, two fixing elements 202 are provided which are arranged in a distance with regard to each other and with the pressure application spindle 38 in-between.

It is also possible to use as a fixing element a slide or a bar or similar gadgets which are fixable on the attachment member 58.

In the embodiment of FIG. 2 the corresponding support is formed on the attachment member 58 and the pressure piece 36 is pushed on and, in particular, inserted into this support. With the embodiment of FIG. 8, the support 200 comprises one or several elements which are separated from the attachment member 58; these elements (fixing elements) are fixed subsequently on the attachment member. The fixing element or fixing elements are pushed at least partially on the pressure piece 36 so as to block the movement of the pressure piece 36 away from the attachment member.

What is claimed is:

1. An arm clamp comprising:

a guide rail, on which a transverse arm is fixed;

a sliding arm which is displaceable on the guide rail and which is tiltable with regard to the guide rail;

a pressure application spindle with a pressure piece, which pressure application spindle is displaceably arranged on the sliding arm so that a pressure force is exertable on a workpiece between transverse arm and sliding arm; and a box-like attachment member for the sliding arm, which provides a substantially flat abutment surface for a workpiece, and is such designed that it is pushable on the pressure piece of the sliding arm to hold the attachment member on the sliding arm;

wherein:

a pressure force is exertable by the attachment member on a workpiece via the pressure application spindle;

the attachment member comprises at least two mutually spaced guide recesses via which it is displaceably mounted on the guide rail;

the attachment member comprises a longitudinal portion and a transverse portion, the guide recesses being formed in the longitudinal portion; and the longitudinal portion is provided, between mutually spaced side walls, with a downward aperture and an upward aperture, so that the sliding bracket is insertable via the upper aperture in an insertion direction between upper aperture and lower aperture and the pressure piece is introducable in the opposite direction into a push-in mounting.

2. The arm clamp as claimed in claim 1, wherein the attachment member is so designed that it can be pushed onto the pressure piece of the sliding arm when the sliding arm is pulled off from the guide rail.

3. The arm clamp as claimed in claim 1, wherein a guide recess embraces the guide rail.

4. The arm clamp as claimed in claim 1, wherein a guide recess is formed in an end wall forming the abutment surface.

5. The arm clamp as claimed in claim 4, wherein a further guide recess is formed in a further end wall of the attachment member, which is a terminal wall of the attachment member.

6. The arm clamp as claimed in claim 1, wherein the attachment member is of one-piece construction.

7. The arm clamp as claimed in claim 1, wherein a support for the pressure piece is provided for fixing the latter on the attachment member.

8. The arm clamp as claimed in claim 7, wherein the support is arranged on the attachment member.

9. The arm clamp as claimed in claim 1, wherein the attachment member comprises as support a push-in mounting for the pressure piece in order to block the movement thereof away from the attachment member parallel to the guide rail.

10. The arm clamp as claimed in claim 7, wherein the support comprises one or more fixing elements which are fixable on the attachment member.

11. The arm clamp as claimed in claim 10, wherein the one or more fixing elements are pushable at least partially on the pressure piece.

12. The arm clamp as claimed in claim 7, wherein the pressure piece is arranged on the pressure application spindle so that the sliding arm with the pressure piece being held by the support is tiltable against the guide rail.

13. The arm clamp as claimed in claim 7, wherein the support is so constructed that the pressure piece is insertable therein transversely to a perpendicular of the abutment surface of the attachment member.

14. The arm clamp as claimed in claim 9, wherein the push-in mounting is formed by a retaining ledge.

15. The arm clamp as claimed in claim 14, wherein the retaining ledge is formed in an interior space of the attachment member.

16. The arm clamp as claimed in claim 1, wherein the attachment member is held on the sliding arm without the use of additional parts.

17. The arm clamp as claimed in claim 1, wherein the attachment member is of L-shaped design.

18. The arm clamp as claimed in claim 17, wherein a push-in mounting for the pressure piece is formed on the transverse portion.

19. The arm clamp as claimed in claim 1, wherein the attachment member is produced from a plastic material.

20. The arm clamp as claimed in claim 1, wherein the flat abutment surface extends at least from the pressure piece to the guide rail.

21. The arm clamp as claimed in claim 20, wherein the flat abutment surface extends beyond the guide rail.

22. The arm clamp as claimed in claim 1, wherein the flat abutment surface is oriented substantially perpendicularly to the guide rail.

23. The arm clamp as claimed in claim 1, wherein the attachment member is guided substantially without tilt on the guide rail.

24. The arm clamp as claimed in claim 1, wherein the sliding arm is guided on the guide rail between the mutually spaced guide recesses.

25. The arm clamp as claimed in claim 1, wherein the guide rail is provided with serrations.

26. The arm clamp as claimed in claim 24, wherein a guide bearing of the sliding arm is so constructed that serrations facing the serrations of the guide rail are formed on first tensioning.

27. The arm clamp as claimed in claim 1, wherein the guide rail is produced from steel.

28. The arm clamp as claimed in claim 1, wherein the sliding arm is produced from zinc.

29. The arm clamp as claimed in claim 1, wherein a releasable locking device is arranged on the guide rail to block the removal of the attachment member and sliding arm.

30. An arm clamp comprising:

a guide rail, on which a transverse arm is fixed;

a sliding arm which is displaceable on the guide rail and which is tiltable with regard to the guide rail;

a pressure application spindle with a pressure piece, which pressure application spindle is displaceably arranged on the sliding arm so that a pressure force is exertable on a workpiece between transverse arm and sliding arm; and a box-like attachment member for the sliding arm, which provides a substantially flat abutment surface for a workpiece, and is such designed that it is pushable on the pressure piece of the sliding arm to hold the attachment member on the sliding arm;

wherein:

a pressure force is exertable by the attachment member on a workpiece via the pressure application spindle;

the attachment member comprises at least two mutually spaced guide recesses via which it is displaceably mounted on the guide rail; and an additional attachment member is provided for the transverse arm in order to provide a substantially flat abutment surface.

31. The arm clamp as claimed in claim 30, wherein the additional attachment member is of one-piece construction.

32. The arm clamp as claimed in claim 30, wherein the additional attachment member is pushable onto the transverse arm.

33. The arm clamp as claimed in claim 30, wherein the additional attachment member is fixable on the transverse arm with non-positive fitting.

34. The arm clamp as claimed in claim 30, wherein the attachment member comprises a longitudinal portion and a transverse portion, the guide recesses being formed in the longitudinal portion.

35. The arm clamp as claimed in claim 34, wherein the longitudinal portion is provided, between mutually spaced side walls, with a downward aperture and an upward aperture, so that the sliding bracket is insertable via the upper aperture in an insertion direction between upper aperture and lower aperture and the pressure piece is introducable in the opposite direction into a push-in mounting.

36. An arm clamp comprising:

a guide rail, on which a transverse arm is fixed;

a sliding arm which is displaceable on the guide rail and which is tiltable with regard to the guide rail;

a pressure application spindle with a pressure piece, which pressure application spindle is displaceably arranged on the sliding arm so that a pressure force is exertable on a workpiece between transverse arm and sliding arm; and a box-like attachment member for the sliding arm, which provides a substantially flat abutment surface for a workpiece, and is such designed that it is pushable on the pressure piece of the sliding arm to hold the attachment member on the sliding arm;

wherein:

a pressure force is exertable by the attachment member on a workpiece via the pressure application spindle;

the attachment member comprises at least two mutually spaced guide recesses via which it is displaceably mounted on the guide rail;

the attachment member comprises an abutment surface having a normal direction transverse to the guide rail via which the arm clamp can be placed on a base.

37. The arm clamp as claimed in claim 36, comprising a support for fixing to the guide rail at or in the vicinity of an end remote from the transverse arm, in order to provide an abutment surface to support the arm clamp on a base.

38. The arm clamp as claimed in claim 37, wherein the support is constructed as a pull-off guard for the attachment member and the sliding arm.

* * * * *